United States Patent [19]

Morishita et al.

[11] Patent Number: 4,646,811

[45] Date of Patent: Mar. 3, 1987

[54] PROCESS FOR FORMING A HIGH ALLOY LAYER ON A CASTING

[75] Inventors: Tuyoshi Morishita, Hiroshima; Yasuhumi Kawado, Iwakuni; Sigemi Osaki; Noriyuki Sakai, both of Hiroshima, all of Japan

[73] Assignee: Mazda Motor Corporation, Hiroshima, Japan

[21] Appl. No.: 727,773

[22] Filed: Apr. 26, 1985

[30] Foreign Application Priority Data

Apr. 27, 1984 [JP] Japan ..... 59-85363

[51] Int. Cl.[4] ..... B22D 19/00

[52] U.S. Cl. ..... 164/103; 164/59.1; 164/97; 164/9

[58] Field of Search ..... 164/59.1, 100, 103, 164/9, 10, 11, 14, 97, 98, 58.1, 72, 75; 428/506, 615; 427/229, 133, 130, 135

[56] References Cited

U.S. PATENT DOCUMENTS

| | | | |
|---|---|---|---|
| 3,361,560 | 1/1968 | Severns . | |
| 3,450,189 | 6/1969 | MacDonald | 164/58.1 |
| 3,792,726 | 2/1974 | Sakai | 164/59.1 |
| 4,197,902 | 4/1980 | Von Jan | 164/72 |

FOREIGN PATENT DOCUMENTS

| | | | |
|---|---|---|---|
| 52-730 | 1/1977 | Japan . | |
| 52-731 | 1/1977 | Japan . | |
| 53-18166 | 6/1978 | Japan . | |
| 57-187159 | 11/1982 | Japan | 164/98 |
| 58-163564 | 9/1983 | Japan | 164/103 |

OTHER PUBLICATIONS

The Condensed Chemical Dictionary, 6th ed, revised by Rose, Reinhold Pub. Corp.

*Primary Examiner*—Kuang Y. Lin
*Assistant Examiner*—G. M. Reid
*Attorney, Agent, or Firm*—Fleit, Jacobson, Cohn & Price

[57] ABSTRACT

A process of forming a high alloy layer on a surface of an aluminum alloy casting. The process comprises steps of providing a mixture of fine powders having an average powder size finer than 10 microns, preferably finer than 1.0 micron, of an alloying metal or an alloying alloy and an acrylic binder, shaping the mixture into a sheet, heat treating the sheet at 150° to 380° C. for more than 5 minutes, placing the heat treated sheet on a surface of a casting mould or a chilling block, and casting molten aluminum alloy.

7 Claims, 3 Drawing Figures

(×100)

(×100)

PROCESS FOR FORMING A HIGH ALLOY LAYER ON A CASTING

BACKGROUND OF THE INVENTION

1. Field of the Invention

The present invention relates to a process of producing a high alloy layer on a surface of a casted workpiece. More particularly, the present invention pertains to a process of producing a high alloy layer on a specific part of a surface of a casted workpiece.

2. Description of Prior Art

Various proposals have hithertofore been made for producing a high alloy layer on a specific part of a surface of a casted workpiece in order for improving various properties such as wear-resistant property, corrosion-resistant property and heat-resistant property of the surface part. Among such proposals, processes applicable to iron-based castings are classified into two groups, one being the process wherein the specific part is alloyed after the casting is moulded and the other being the process wherein the specific part is alloyed while the workpiece is being moulded. The former process is considered as being disadvantageous from the economical point of view in that additional steps and facilities are required for alloying. In the latter process, alloying metals or mixtures of the alloying metal powders and suitable binders such as synthetic resins are attached in advance to surfaces of casting moulds corresponding to the specific parts of the workpieces where the alloyings are to be made and casting steps are carried out by pouring molten cast metal into the moulds to thereby form alloys on the specific parts of the casted workpieces under the heat of the molten metal. For example, Japanese patent publication No. 52-730 proposes to provide a mixture of powders of metal carbides and a liquid binder such as triethyleneglycol and apply the mixture to a desired part of the mould surface to form a film by having the mixture dried. A following casting steps will then produce an alloy on a desired part of the casted workpiece due to the existence of the metal carbides. The proposed process is however disadvantageous in that the binder is resolved under the heat of the molten casting metal producing gaseous products which cause pin holes and voids in the casted workpiece.

Japanese patent publication No. 52-731 proposes to provide a mixture of powders of a metal or an alloy and powders of thermosetting resin and form the mixture under heat into a piece of a desired shape. The piece is then applied to a desired part of the casting mould before the molten casting metal is poured into the mould. This process is also disadvantageous in that the thermosetting resin is resolved under the heat of the molten metal producing gaseous products. Japanese patent publication No. 53-18166 proposes to provide a mixture of powders of an alloy containing Te, Cu and S and powders of graphite. The mixture is then added with alcohol and applied to a desired part of the casting mould. Thereafter, molten metal containing C, Si, Mn, V, Ni and Fe is poured into the mould. The proposed process is disadvantageous in that it can be applied only to casting metal of a specific composition.

SUMMARY OF THE INVENTION

It is therefore an object of the present invention to provide a process for forming a high alloy layer on a specific part of a casting without producing pin holes and voids.

Another object of the present invention is to provide an economical and reliable process for forming a high alloy layer on a casting.

According to the present invention, the above and other objects can be accomplished by a casting process comprising steps of providing a surface of at least one of a casting mould and a chilling block with a layer of a mixture of fine powders of at least one of alloying metal and alloying alloy with an acrylic adhesive binder, said surface corresponding to a part of a surface of a casted product wherein a high alloy layer is to be produced, said powders having an average powder size finer than 10 microns, said layer of the mixture being heat treated at 150° to 380° C. for more than 5 minutes, and casting a molten metal into the mould to produce the casted products having the high alloy layer. In a preferable process, the high alloying metal or the high alloying alloy is used in the form of ultra-fine powders.

The powders of the high alloying metal or the high alloying alloy may be those which are commonly used for applying the base material with a specific property such as a corrosion-resistant property, a wear-resistant property or a heat-resistant property. In case where the casting is of an iron-based material, various types of iron-based alloys can be used as the alloying alloy. For example, use may be made of high carbon ferrochromium containing 60 to 70 wt % of Cr, 6 to 9 wt % of C, less than 8.0 wt % of Si and the balance of Fe for providing a supply of Cr, high carbon ferromolybdenium containing 55 to 65 wt % of Mo, 5 to 6 wt % of C, less than 3 wt % of Si and the balance of Fe for providing a supply of Mo, high carbon ferroboron containing 14 to 23 wt % of B, 0.5 to 2.0 wt % of C, less than 4 wt % of Si and the balance of Fe for providing a supply of B, powders of Cu for providing a supply of Cu, powders of Ni or ferronickel for providing a supply of Ni, powders of Co for providing a supply of Co and powders of Si for providing a supply of Si. The powders of these alloys and metals may be used separately or in combination for accomplishing the desired purpose.

One of the important features of the present invention is to use fine powders, preferably ultra-fine powders of the high alloying metal or alloy. The metal or alloy powders used in the present invention have an average powder size finer than 10 microns, preferably finer than 1.0 micron. Powders having an average powder size are generally called as ultrafine powders. Fine powders used in the process of the present invention are known as being able to produce an alloy at a significantly lower temperature as compared with powders of ordinary powder size. As an example, Ni powders having an average powder size start to produce an alloy at a temperature of approximately 1,150° C., whereas fine powders of Ni having an average powder size of 7 microns start to produce an alloy at approximately 600° C. In case of ultra-fine powders, the alloying temperature is as low as approximately 300° C. The present invention utilizes the property of fine powders of metal or alloy in which the alloying temperature is significantly decreased. It is therefore possible to produce a high alloy layer on a specific part of a casting while the casting is being moulded even when the moulding temperature is low such as in case of an aluminum casting.

Materials which can be preferably used as the acrylic adhesive binder include a polymer and a copolymer of acrylic ester and methacrylic ester, and a copolymer of these esters and a polymerizable monomer having a functional group copolymerizable with these esters.

The powders of high alloying metal or alloy may be suitably mixed with the binder in an amount of 90 to 99 wt % of the metal or alloy powders for 10 to 1 wt % of the resin. Where the resin content is less than 1 wt %, a sufficient adhesive powder will not be obtained so that the metal or alloy powders will not be adhesively retained on the surface of the mould or the chilling block. Where the binder content is greater than 10 wt %, the excess resin may cause a decrease in the connecting power between the high alloy layer and the casting surface.

There may be various ways of applying the mixture of the powders of the alloying metal or alloy and the acrylic adhesive binder to the mould surface. For example, the mixture of the metal or alloy powders and the binder may be added with a suitable amount of solvent such as acetone, toluene and methylethylketone to form a fluid form or a paste-like mixture which may then be applied to the mould surface. Alternatively, the mixture of the metal or alloy powders and the binder may be formed into a sheet which may be adhesively attached to the mould surface. Such sheet can be formed in various ways. For example, the aforementioned fluid form or paste-like mixture may be put into a shaping mould to have the solvent evaporated and the mixture thus shaped may be passed through a nip between a pair of rolls to form a sheet of 0.5 to 5.0 mm thick. Alternatively, the mixture of the metal or alloy powders and the binder may be kneaded by applying a heat if necessary and formed into a sheet. The powder sheet thus formed can readily be adhesively attached to the mould or the chill simply by pressing it thereto. If necessary, however, acrylic resin which is the same type as that used as the binder may be applied in advance to the mould or the chilling block to form a temporary adhesive layer. Alternatively a sheet of adhesive binder may be used as an adhesive.

After the mixture of the metal or alloy fine powders and the acrylic adhesive binder is applied to the mould or the chilling block in the form of a sheet-like powder layer, the molten metal is poured into the mould to form a casting. The heat of the molten metal then causes the metallic components in the powder layer to melt and/or diffuse into the casting to thereby form a layer of a high alloy in the casting.

It should however be noted that the resin component in the powder layer may be resolved under the heat of the molten metal to produce gaseous products which may cause pin holes and voids in the casting. Further, the powder layer may be removed from the mould surface or displaced on the mould in the casting process. In order to prevent the above problems completely, a preheating should be carried out after the powder layer is formed on the mould or chilling block surface or before the powder layer is attached to the mould or chill surface. The preheating should be carried out in a non-oxidating atmosphere such as in an atmosphere of an inactive gas, for example, nitrogen and argon, a reduction gas, for example, hydrogen, or in a vacuum. It is preferable that the heating rate be less than 40° C./min. With the heating rate higher than 40° C./min., there will be an abrupt evaporation of those components having a low boiling point in the binder so that the powder layer may be broken or bubbles may be produced causing removal of the powder sheet from the mould or chilling block surface.

The preheating may be carried out at 150° to 380° C., preferably at 200° to 350° C. for more than 5 minutes. Through the preheating, the resin binder is subjected to a pyrolytic condensation reaction without being completely burnt producing a tar-pitch like substance which functions to provide an adhesive powder for maintaining the powder layer on the mould or chilling block surface. It should therefore be noted that according to this process it is possible to prevent removal or displacement of the powder layer under shock loads, vibrations and heat to which the powder layer is subjected in the casting process.

With the preheating temperature lower than 150° C., the pyrolytic condensation reaction of the resin will not be sufficiently produced so that a sufficient quantity of the tar-pitch like substance for providing a satisfactory adhesive power. Where the preheating temperature is higher than 380° C., the resin component will be abruptly resolved so that a sufficient amount of tar-pitch like substance will not be produced. Where the preheating time is less than 5 minutes, a sufficient amount of the tar-pitch like substance will not be produced. The preheating time and temperature may be determined in accordance with the type of the resin, however, it is in general unnecessary to maintain at the preheating temperature for more than 120 minutes.

According to the process of the present invention, the process of forming a high alloy can be progressed rapidly due to the use of fine powders, preferably ultra-fine powders of alloying metal or alloying alloy. It is also possible to form a high alloy layer at the time of casting even when the molten metal is of a relatively low temperature. It is therefore possible to apply the process of the present invention to produce for example shift-forks for automobile transmission mechanisms or rocker arms for internal combustion engines with an aluminum based alloy, wherein the high alloy layers may be formed in sliding surfaces of such products. Where the powder layer is formed on the chilling block surface, a high alloy layer can be formed while it is being chilled so that it is possible to form an excellent wear-resistant surface. By performing the preheating, it is possible to prevent pin holes and voids substantially completely. It becomes also possible to prevent removal and displacement of the powder layer during the casting process. By using the powder sheet, it is possible to uniformize and control the thickness and the location of the high alloy layer.

BRIEF DESCRIPTION OF THE DRAWINGS

FIG. 3 is a flow sheet which shows the process carried out in Example 2.

EXAMPLE 1

Ultra-fine powders having powder size finer than 1 micron of Cu-Ni alloy containing 10 wt % of Ni and the balance of Cu are mixed in an amount of 50 wt % with 50 wt % of acrylic adhesive binder, the binder being diluted in advance by acetone, and the mixture is kneaded to form a slip which is then poured over a releasing paper to have it dried to thereby form a Cu-Ni powder sheet of 1.5 mm thick which is adhesively attached to a steel plate of 15 mm wide, 20 mm long and 0.7 mm thick. Then, the specimen is heated in an atmosphere of hydrogen to 300° C. and maintained at the temperature for 60 minutes. After the preheating, the powder sheet is removed from the steel plate and placed on a die of a die-cast machine. Then, a die-cast process is carried out with a molten state of AC4C alloy which meets the requirements of Japan Industrial Standard (JIS-H-5202), of which temperature is 760° C. With this process, a Cu-Ni type alloy layer is formed on the AC4C alloy casting.

EXAMPLE 2

Figure 1:
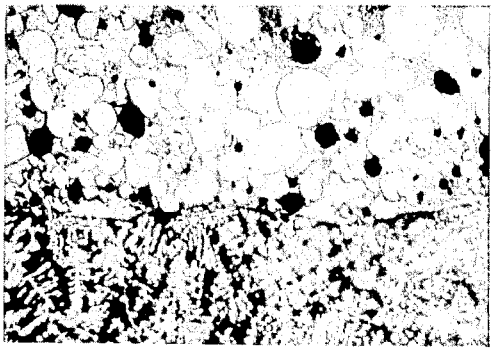
FIG. 1 is a microscopic photograph of a Cu-Ni type high alloy layer formed on the surface of an AC4C cast alloy; and, FIG. 2 is a microscopic photograph of a Ni alloy layer produced in accordance with the process of the present invention.

Fine powders having an average powder size of 7 microns of Cu-Ni alloy containing 10 wt % Ni and 90 wt % of Cu are mixed in an amount of 96.4 wt % with 3.6 wt % of acrylic adhesive resin binder, the binder being in advance diluted by toluene, and the mixture is kneaded and rolled to form a powder sheet of 1.5 mm thick. The powder sheet is then adhesively attached to a steel plate of 15 mm wide, 20 mm long and 0.7 mm thick and heated in an atmosphere of hydrogen to 300° C. and maintained at the temperature for 60 minutes. The powder sheet is then removed from the steel plate and placed on a casting mould. Thereafter, a casting process is carried out by pouring molten state AC4C aluminum alloy of 760° C. into the mould. It is found that an alloy layer is formed on a surface of the casting of AC4C alloy. The alloy layer is shown in the upper part of FIG. 1. It will be seen in FIG. 1 that a new alloy phase is produced by the Cu-Ni alloy and AC4C alloy in addition to grains of Cu-Ni alloy. The new alloy phase functions to increase the bonding power between the alloy layer and the base casting metal. The steps of the process are pictured in FIG. 3.

EXAMPLE 3

Figure 2:
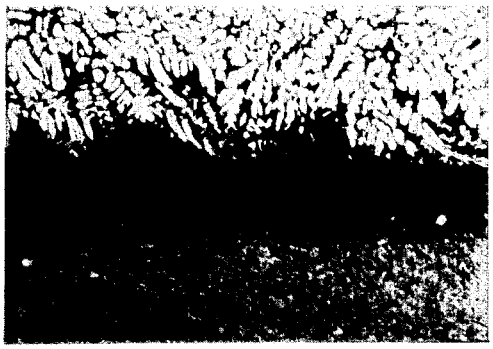

Ultra-fine powders having powder size finer than 0.1 micron of Ni are mixed in an amount 50 wt % with 50 wt % of acrylic adhesive binder, the binder being in advance diluted by acetone, and the mixture is then kneaded to form a slip. The slip is developed on a releasing paper and dried to form a powder sheet of 2.0 mm thick. The powder sheet is adhesively attached to a steel plate of 15 mm wide, 20 mm long and 0.7 mm thick and heated in an atmosphere of hydrogen to 300° C. and maintained at the temperature fo 60 minutes. Thereafter, the powder sheet is removed from the steel plate and attached to a die of a die-cast machine. Then, a die-cast process is carried out by molten state AC4C aluminum alloy of 760° C. It is found that an alloy layer is formed on a surface of the AC4C casting. FIG. 2 shows in the lower part the alloy layer thus formed.

The invention has thus been shown and described with reference to specific examples, however, it should be noted that the invention is in no way limited to the details of the examples specifically described.

We claim:

1. A casting process comprising steps of providing a surface of a moulding member selected from the group consisting of a casting mould and a chilling block with a layer of a mixture of fine powders of one selected from the group consisting of alloying metal and alloying alloy, with an acrylic adhesive binder, said surface corresponding to a part of a surface of a casted product wherein a high alloy layer is to be produced, said powders having an average powder size smaller than 10 microns, heating said layer of the mixture at 150° to 380° C. in a non-oxidizing atmosphere for more than 5 minutes, and casting a molten metal into the moulding member to produce the casted products having the high alloy layer.

2. A casting process in accordance with claim 1 in which said powders have an average powder size smaller than 1.0 micron.

3. A casting process in accordance with claim 1 in which said acrylic adhesive binder is selected from the group consisting of a polymer and a copolymer of acrylic ester and methacrylic ester, and a copolymer of these esters and a copolymerizable monomer having a functional group copolymerizable with these esters.

4. A casting process in accordance with claim 1 in which said fine powders are mixed in an amount of 90 to 99 wt % with 10 to 1 wt % of the binder.

5. A casting process in accordance with claim 1 in which said layer of the mixture of the fine powders and the binder is formed by producing a sheet of the mixture and thereafter attaching the sheet to said surface.

6. A casting process in accordance with claim 5 in which said heating step is carried out before attaching the sheet to said surface.

7. A casting process comprising steps of producing a sheet of a mixture of fine powders of one selected from the group consisting of alloying metal and alloying alloy, with an acrylic adhesive binder, said powders having an average powder size smaller than 10 microns, heating said sheet at 150° to 380° C. in a non-oxidizing atmosphere for more than 5 minutes, attaching said sheet onto a surface of a moulding member selected from the group consisting of a casting mould and a chilling block, said surface corresponding to a part of a surface of a casted product wherein a high alloy layer is to be produced, and casting a molten aluminum into the moulding member to produce the casted products having the high alloy layer.

* * * * *